US005588849A

United States Patent [19]

Kile

[11] Patent Number: 5,588,849

[45] Date of Patent: Dec. 31, 1996

[54] CONNECTOR WITH PIN TERMINALS ADAPTED FOR SURFACE MOUNTING

[75] Inventor: Richard A. Kile, Harrisburg, Pa.

[73] Assignee: The Whitaker Corporation, Wilmington, Del.

[21] Appl. No.: 691,441

[22] Filed: Aug. 2, 1996

Related U.S. Application Data

[63] Continuation of Ser. No. 325,007, Oct. 18, 1994, abandoned.

[51] Int. Cl.[6] ..... H01R 9/09

[52] U.S. Cl. ..... 439/83; 439/78

[58] Field of Search ..... 439/678, 67, 78, 439/79, 80, 83, 679

[56] References Cited

U.S. PATENT DOCUMENTS

| | | | |
|---|---|---|---|
| 4,410,229 | 10/1983 | Stephenson | 339/98 |
| 4,609,241 | 9/1986 | Peterson | 339/17 CF |
| 4,695,106 | 9/1987 | Feldman et al. | 439/87 |
| 4,732,565 | 3/1988 | Ito et al. | 439/79 |
| 4,807,087 | 2/1989 | Sawaya | 439/83 |
| 4,917,614 | 4/1990 | Kikuchi et al. | 439/83 |
| 4,936,792 | 6/1990 | Onoue et al. | 439/67 |
| 5,013,250 | 5/1991 | Schulz | 439/79 |
| 5,109,269 | 4/1992 | Holzman | 357/74 |
| 5,169,347 | 12/1992 | Sang | 439/885 |
| 5,199,885 | 4/1993 | Korsunsky et al. | 439/79 |
| 5,199,887 | 4/1993 | Iacono | 439/83 |
| 5,201,664 | 4/1993 | Korsunsky et al. | 439/83 |
| 5,242,311 | 9/1993 | Seong | 439/135 |
| 5,254,016 | 10/1993 | Ganthier | 439/567 |

FOREIGN PATENT DOCUMENTS

| | | | |
|---|---|---|---|
| 0087126 | 8/1983 | European Pat. Off. | 439/83 |

*Primary Examiner*—Hien Vu
*Attorney, Agent, or Firm*—Anton P. Ness

[57] ABSTRACT

An electrical connector (1) comprises, a base (3) adapted to be mounted on a surface (24) of a circuit board (20), and multiple conductive pin terminals (4) extending below the base (4), and selected ones of the pin terminals (4) being bent to extend across the surface (24) of the circuit board (20) to provide surface mount pin terminals (40), and at least one of the pin terminals (4) being unbent to provide a locating pin terminal (4) adapted to be soldered in an opening (22) through the same circuit board (20).

5 Claims, 3 Drawing Sheets

CONNECTOR WITH PIN TERMINALS ADAPTED FOR SURFACE MOUNTING

This application is a continuation of application Ser. No. 08/325,007 filed Oct. 18, 1994, now abandoned.

FIELD OF THE INVENTION

The invention relates to an electrical connector having electrically conductive pin terminals that are adapted to fit in openings through a circuit board.

BACKGROUND OF THE INVENTION

An electrical connector having an array of voltage carrying, conductive pin terminals is known from U.S. Pat. No. 5,013,250. The pin terminals are on the order of 0.025 inches square, making them rigid and resistant to being bent when they are inserted into plating lined openings through a circuit board, and when they are mated with receptacle contacts on another, mating connector. The pin terminals extend through the openings and establish electrical connections with the plating lined openings.

A circuit board comprises, a board of insulating material, and planar conductive circuits on external surfaces of the board. A multilayer circuit board is a circuit board constructed with multiple layers of insulating material, and planar conductive circuits extending along the layers. The circuits on the circuit board are routed to avoid the pin terminals, except when the circuits intentionally connect with a plating lined opening to establish a connection with a pin terminal through the opening.

The openings through the circuit board consume space on the circuit board that could have been used for routing the circuits. The openings tend to crowd the circuits when the circuits are routed to avoid the pin terminals. Replacing the openings with solder pads will provide additional space to reduce crowding of the circuits.

Surface mount technology, SMT, refers to technology involving surface mount terminals that mount to solder pads on an exterior surface of a circuit board. Solder is used to join these surface mount terminals to the pads. To prevent the solder joints from being dislodged, fasteners, such as, small bolts, hold the connector in place on the circuit board.

According to U.S. Pat. No. 5,013,250 conductive pin terminals in an electrical connector are bent to point in two different directions to plug the pin terminals into two different circuit boards. The pin terminals extend through openings in both circuit boards, and are not terminals that reduce the number of openings through the circuit boards.

According to U.S. Pat. No. 4,732,565, conductive terminals in an electrical connector are bent in two directions to orient the connector in one of the two directions while on a circuit board. The terminals are surface mount terminals without a locating pin terminal that holds the connector to a circuit board.

SUMMARY OF THE INVENTION

A feature of the invention resides in bent conductive pin terminals in an electrical connector to provide SMT terminals for connection to a circuit board, while another pin terminal is unbent to provide a locating pin terminal and a fastener that holds the connector in place on the circuit board.

An advantage of the invention resides in conductive pin terminals of an electrical connector being adapted for surface mount connection to a circuit board, or for use as a locating pin terminal and a fastener to hold the connector in place on a circuit board.

According to an embodiment of the invention, conductive pin terminals in a connector are adapted to mate with electrical receptacles of another mating electrical connector, and are each adapted to be bent over to extend along a surface of a circuit board for connection to the circuit board as surface mount terminals, or remain unbent to provide a locating pin terminal and a fastener that holds the connector in place on the circuit board.

DESCRIPTION OF THE DRAWINGS

An embodiment of the invention will now be described by way of example with reference to the accompanying drawings, according to which.

DETAILED DESCRIPTION

Figure 1:
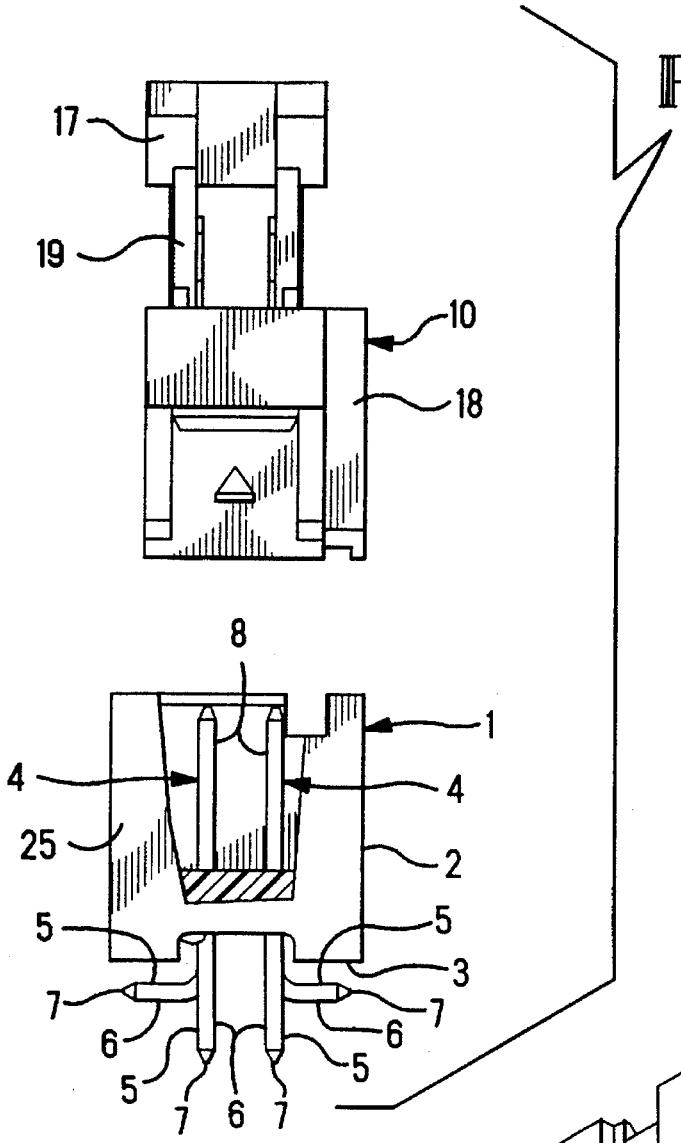
FIG. 1 is an end view, with parts separated from one another, and with parts cut away, of a connector aligned for mating with another mating electrical connector.
Figure 2:
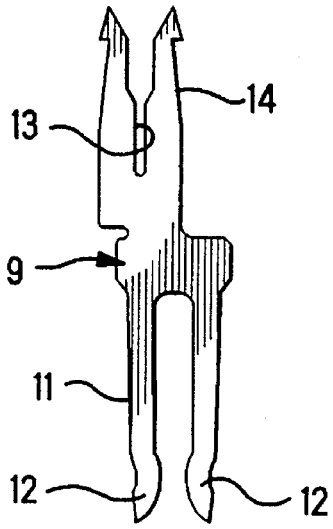
FIG. 2 is a plan view of a mating electrical contact of the mating electrical connector shown in FIG. 1.
Figure 3:
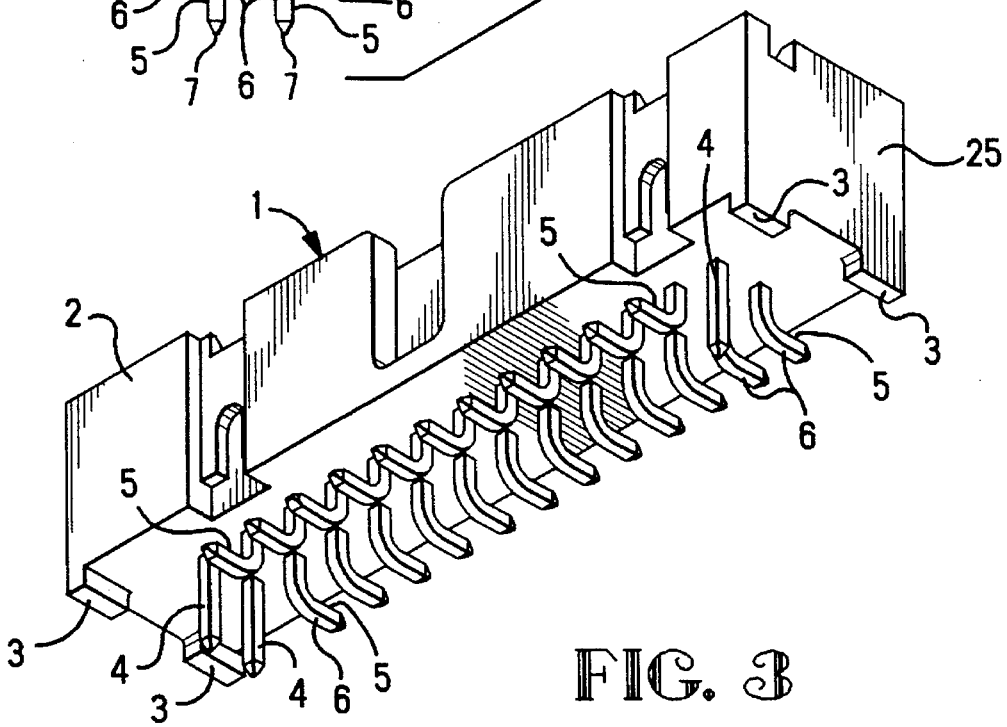
FIG. 3 is an isometric view of the connector shown in FIG. 1.
Figure 4:
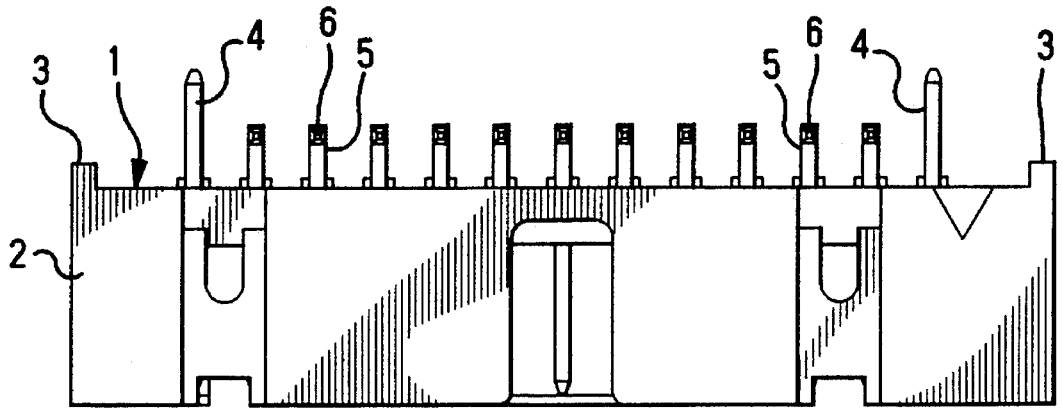
FIG. 4 is an inverted side view of the connector shown in FIG. 3.
Figure 5:
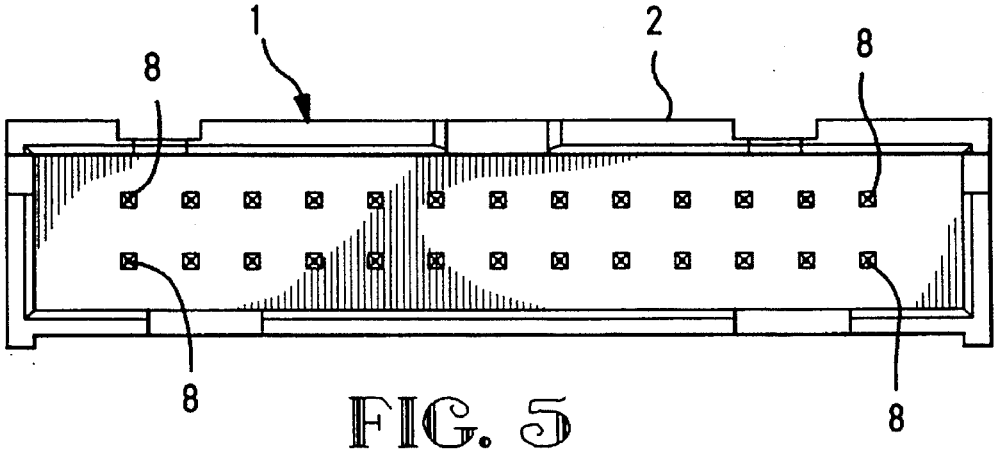
FIG. 5 is a front view of the connector shown in FIG. 3.

With reference to FIGS. 1, 2 and 3, an electrical connector 1 comprises an insulating housing 2, a base 3 on the housing 2 provided by projecting feet on the housing 2, and two rows of multiple conductive terminals 4 mounted to the housing 2. Each of the pin terminals 4 is of rigid, unitary construction with a polyhedron cross section, for example, a square cross section. Each terminal 4 is constructed with an electrical pin terminal portion 5 extending below and initially orthogonally from the base 3, and having a planar surface 6 extending to a pointed tip 7. An electrical contact portion 8 of each terminal 4 projects above the base 3 for mating connection to respective, mating electrical contacts 9 of a mating electrical connector 10.

With reference to FIGS. 1 and 2, each mating electrical contact 9 comprises, an electrical receptacle 11 at one end, having spaced apart spring fingers 12, and a conductor terminating slot 13 opening to another end of the mating contact 9 that comprises a conductor terminating electrical terminal 14. The mating contact 9 is of unitary, stamped and formed construction.

Figure 7:
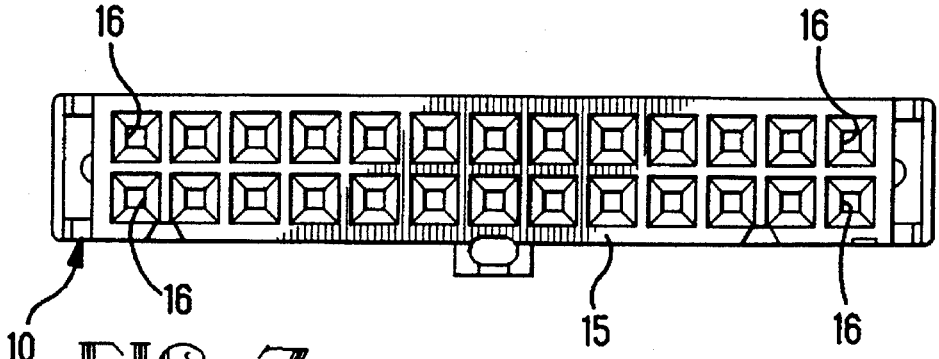
FIG. 7 is a front view of the mating connector shown in FIG. 1.
Figure 8:
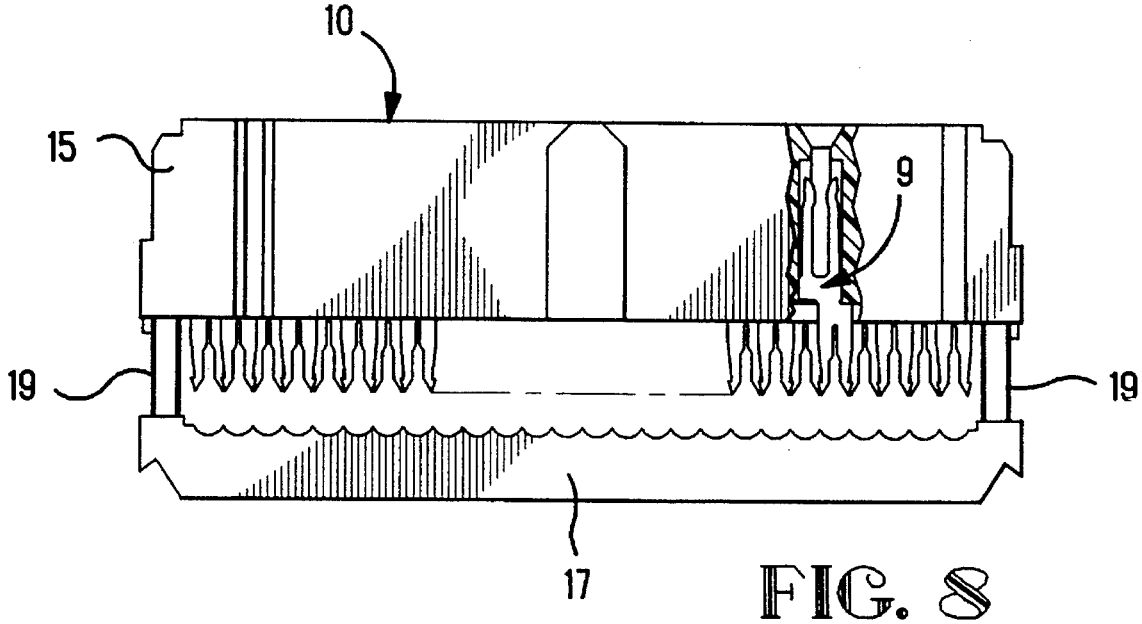
FIG. 8 is a side view of the connector shown in FIG. 7.
Figure 9:
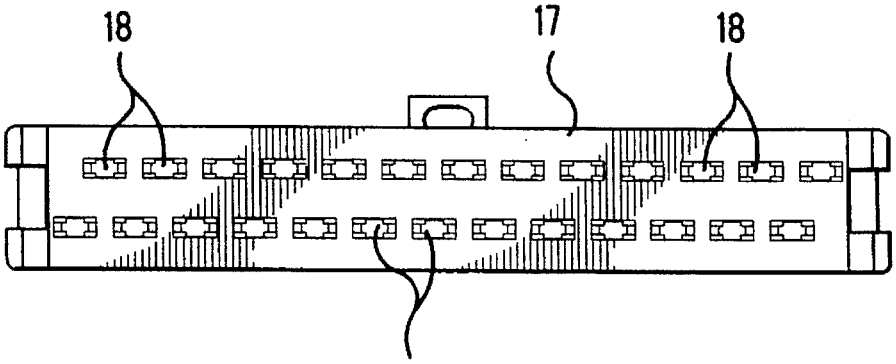
FIG. 9 is rear view of the connector shown in FIG. 7.

With reference to FIGS. 7, 8 and 9, the mating electrical connector 10 comprises, an insulating housing 15, multiple said mating contacts 9 in contact receiving cavities 16 in the housing 15, and an insulating cover 17 with terminal receiving passages 18. Latches 19 project from the cover 17 and engage the housing 18. Further details of the mating connector 10 are described in U.S. Pat. No. 4,410,229. Similarly as described in U.S. Pat. No. 3,820,055, the mating connector 10 is adapted to terminate, for example, conductors of a flat flexible cable, not shown, with respective slots 13 in the respective terminals 14 of the mating contacts 9.

With reference to FIGS. 1 and 2, the connector 1 is aligned for mating with the mating electrical connector 10, with the contacts 9 of the terminals 4 being aligned with respective receptacles 11 for receipt and frictional connection between the spring fingers 12 of respective receptacles 11.

Figure 6:
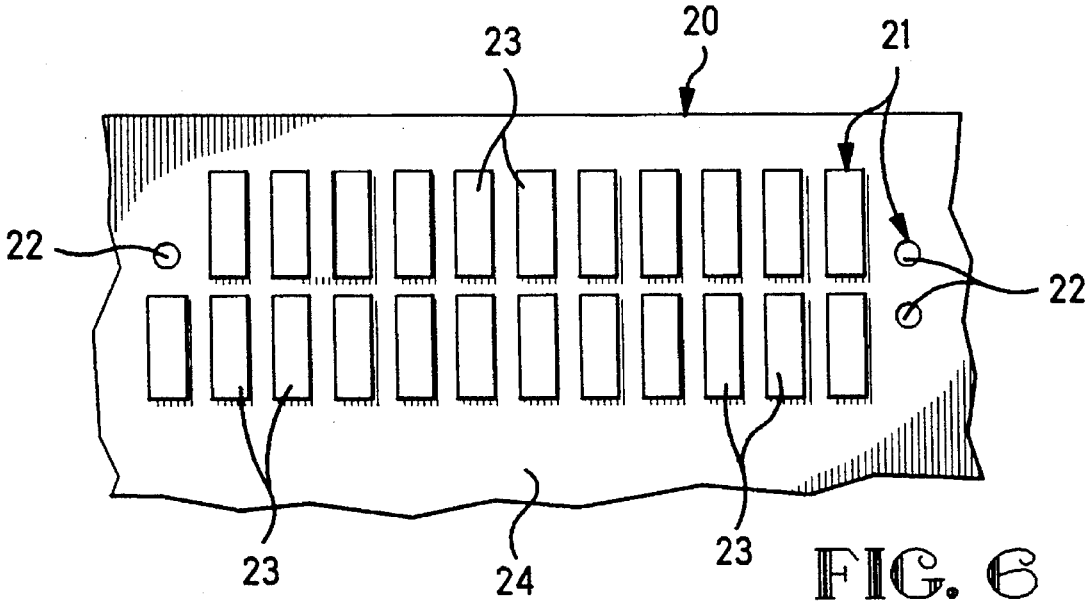
FIG. 6 is a combination of plating lined openings through a circuit board and conductive pads on an exterior surface of the circuit board.

With reference to FIG. 6, a circuit board 20 is provided with a combination of conductive sites or areas 21 comprising, three plating lined openings or through-holes 22 through the circuit board 20 and multiple, elongated conductive pads 23 on an exterior surface 24 of the circuit board 20. The openings 22 and the pads 23 are arranged in two rows, with each opening 22 being at a corresponding end of a row. Each unbent pin terminal portion 5 is adapted to be soldered to a plating lined opening 22. Each bent pin terminal portion 5 is adapted to be soldered to a pad 23, or to metal plating in an opening 22, as explained hereinafter.

With reference to FIGS. 1, 3, 4 and 6, the base 3 on the housing 2 is adapted to mount on the surface 24 of the circuit board 20. The pin terminal portions 5 initially extend orthogonally from a bottom surface of base 3 and are initially unbent along their lengths. Selected ones of the pin terminals 4 are bent, where they extend below the base 3 on the housing 2, to extend in a direction, across the surface 24 of the circuit board 20, and to provide elongated surface mount pin terminal portions 5 that are aligned with respective elongated pads 23. The selected ones of the pin terminal portions 5 are bent to project their planar surfaces 6 facing away from the base 3 on the housing 2. At least one of the pin terminal portions 5 remains unbent to provide a locating pin terminal portion 5 adapted to be soldered in a corresponding opening 22 through the same circuit board 20. For example, the unbent pin terminal portion 5 projects farther below the base 3 and toward the circuit board 20 than each of the bent pin terminals 4, and thereby, extends into a corresponding opening 22 before the bent pin terminal portions 5 impinge respective pads 23.

The unbent pin terminal portion 5 in a corresponding opening 22 aligns the bent pin terminal portions 5 with respective pads 23 and provides a keying combination of pin terminals 4 that match the keying combination of the conductive areas 21. When the openings 22 of the circuit board and the corresponding unbent pin terminal portions 5 are asymmetrically positioned in their respective arrays, as shown in FIGS. 3 and 6, the connector can only be mounted in one orientation and thus is polarized.

Keyed alignment of opposite ends 25 of the housing 2 is provided by a keying combination of additional, respective single, unbent pin terminal portions 5, at corresponding ends of the rows of the pin terminals 4, to provide pin terminal portions 5 in alignment with the three openings 22 in the combination of conductive areas 21, as shown in FIG. 6. The keying combination of unbent pin terminal portions 5 are adapted to be soldered in a matching keying combination of openings 22 through the same circuit board 20. The combination of openings 22 and pads 23 provide a changeable keying combination. Thus the connector and the circuit board can be considered to be programmable to key the circuit board to a connector of the present invention with a particular arrangement of bent and unbent pin terminal portions by providing a circuit board through-hole for each unbent pin terminal portion. The keying combination can be changed, by selecting either a pad 23 or an opening 22 for each the conductive areas 21. The combination of bent and unbent pin terminal portions 5 provides a keying combination selected to match the keying combination of openings 22 and pads 23. An unbent pin terminal portion 5 in the keying combination must extend in an opening 22. A bent pin terminal portion 5 in the keying combination can extend across either a pad 23 or an opening 22. A sufficient quantity of solder will bridge between a bent pin terminal portion 5 and metal plating in the plating lined opening 22 to establish a solder connection. Accordingly, each bent pin terminal portion 5 can match a keying combination providing either an opening 22 or a pad 23 matched with the bent pin terminal portion 5.

Additional embodiments and modifications are intended to be covered by the spirit and scope of the appended claims.

I claim:

1. An electrical connection arrangement comprising:

a circuit board having a connector site having a plurality of contact pads in an array of at least two rows thereof on a board surface, and at least two through-holes substantially at ends of the array of contact pads, the contact pads and at least two through-holes defining electrical connection sites; and an electrical connector comprising an insulative housing including a base having a bottom surface mounted on a surface of a circuit board, and including at least twelve conductive terminals disposed in said housing and including respective pin terminal portions, said pin terminal portions extending initially orthogonally beyond said bottom surface of said base in an array of at least two rows, at least two of the pin terminal portions at ends of said at least two rows being unbent to provide locating pin terminal portions adapted to be soldered in the at least two through-holes of the circuit boards, and remaining pin terminal portions being bent to extend parallel to the base and across respective contact pads along the surface of the circuit board, with ones of said bent terminal portions extending in a first direction and others thereof extending in an opposed second direction to provide at least two rows of surface mount electrical connections with said at least two rows of contact pads, remaining portions of said conductive terminals being identical within said housing, and said at least two through-holes being located asymmetrically within the array of contact pads, and said at least two unbent terminal portions being correspondingly located asymmetrically within the array of terminal portions, whereby the circuit board need not provide a through-hole at every electrical connection site thereof, and said connector is keyed by selecting said at least two terminal portions located asymmetrically within the array of terminal portions to remain unbent while the remaining terminal portions are bent, to establish polarization with respect to the circuit board to allow mounting in only a single orientation.

2. An electrical connector arrangement as recited in claim 1 wherein the pin terminal portions are constructed with planar surfaces extending to pointed tips, and said planar surfaces of the selected ones of the pin terminal portions face away from the base on the housing.

3. An electrical connector arrangement as recited in claim 1 wherein mating ends of the conductive terminals extend above the base for mating connection with another mating electrical connector.

4. An electrical connector arrangement as recited in claim 1 wherein said conductive terminals comprise a rectangular cross-section continuously therealong.

5. An electrical connector arrangement as recited in claim 1 wherein said conductive terminals comprise a square cross-section continuously therealong.

* * * * *